US008907786B2

(12) United States Patent
Schuller

(10) Patent No.: US 8,907,786 B2
(45) Date of Patent: Dec. 9, 2014

(54) METHOD OF ALERTING OWNERS TO THEFT OF PROPERTY

(76) Inventor: Carmen Schuller, New York, NY (US)

( * ) Notice: Subject to any disclaimer, the term of this patent is extended or adjusted under 35 U.S.C. 154(b) by 175 days.

(21) Appl. No.: 13/558,649

(22) Filed: Jul. 26, 2012

(65) Prior Publication Data

US 2013/0027201 A1 Jan. 31, 2013

Related U.S. Application Data

(60) Provisional application No. 61/512,786, filed on Jul. 28, 2011.

(51) Int. Cl.

| | |
|---|---|
| ***G08B 1/08*** | (2006.01) |
| ***G08B 13/14*** | (2006.01) |
| *G08B 25/00* | (2006.01) |

(52) U.S. Cl.

CPC ..... *G08B 13/1472* (2013.01); *G08B 25/008* (2013.01)

USPC ..... 340/539.13; 340/568.1; 340/572.9

(58) Field of Classification Search

USPC ..... 340/568.1, 568.8, 568.7, 568.2, 568.5, 340/571, 572.1, 572.9, 572.7, 393.3, 539.13

See application file for complete search history.

(56) References Cited

U.S. PATENT DOCUMENTS

| | | | | |
|---|---|---|---|---|
| 5,781,109 | A * | 7/1998 | Nakajima | 340/571 |
| 2002/0097152 | A1* | 7/2002 | Mengrone et al. | 340/571 |
| 2006/0109115 | A1* | 5/2006 | Bradus et al. | 340/568.2 |
| 2008/0224868 | A1* | 9/2008 | Huang | 340/572.1 |
| 2009/0109027 | A1* | 4/2009 | Schuller | 340/568.1 |
| 2010/0277396 | A1* | 11/2010 | Gross et al. | 343/878 |

* cited by examiner

*Primary Examiner* — Daniel Previl

(74) *Attorney, Agent, or Firm* — Leason Ellis LLP

(57) ABSTRACT

The present invention is directed to an anti-theft system for protecting portable personal items attached to the system and remotely signaling their removal. The system includes a base secured in place on the edge of a table or a wall. A pressure detecting mechanism is disposed to hang from the base so it can be used to hold the personal item, and so that the presence or absence of the item from the pressure detecting mechanism can be detected. Once the device is activated and a valuable personal item is placed on the pressure detecting mechanism, the removal of the item without first deactivating the device will cause an alarm to be activated. The alarm may be a sound or flashing light on the base of the device or generate a signal that may be received remotely by the owner.

17 Claims, 3 Drawing Sheets

METHOD OF ALERTING OWNERS TO THEFT OF PROPERTY

RELATED APPLICATIONS

This application claims the benefit of priority to provisional patent application 61/512,786, which was filed Jul. 28, 2011 under 35 U.S.C. 119(e), herein incorporated by reference in its entirety.

BACKGROUND OF THE INVENTION

1. Field of the Invention

The present invention relates to apparatus for protecting valuable portable objects against theft.

2. Discussion of the Related Art

While at social events conducted at commercial establishments, particularly night clubs, it is common for people to leave their personal items on tables or wall hooks. This can typically occur while the person is using a restroom, dancing or chatting with people at other tables in the establishment. These items include purses, articles of clothing (e.g., sweaters and jackets), and small electronic devices (e.g., Ipods, Walkman, cell phones, etc.). Unscrupulous individuals survey such establishments for opportunities to steal these valuable articles when they are unattended. The resulting theft causes the establishment owner to have to deal with customer complaints that could harm the reputation of the club and the theft could create liability for the owner. Of course, the theft also results in the loss of the property to the owner, which may not only be monetarily valuable, but have sentimental value.

A solution to this problem has been proposed in U.S. Pat. No. 5,594,419 to Lo, which is incorporated herein by reference in its entirety. In particular, the Lo patent discloses a table-edge hanger device that can be used to protect personal items, such as a purse or a jacket, against theft. The device has a square base that can be placed near the edge of a table. A hanger, on which valuable items can be hung, extends from the base over the edge of the table. Further, a microswitch is located in the base and is arranged to so that it is operated if an item is placed on the hanger. In use the owner of a personal item hooks it on the hanger and if it is removed, the microswitch senses the change and causes an alarm in the form of either a warning light or a sound, to be activated. A further switch in an inconspicuous place can be used to turn the device on and to turn it off, thus turning off the alarm. A further solution to the problem has been provided in US 2009/0109027 to Schuller herein incorporated by reference in its entirety.

Because of the public location, the alarm in a system such as that in the Lo patent is made to have a limited range, so as not to disturb others when there is a false alarm, e.g., when the rightful owners removes the item without turning off the device. Also, even when the alarm is made noticeable over a significant distance, there is no guarantee that the owner will be notified. For example the owner may be at a restroom on another floor. Those sitting near the device exhibiting the alarm may not have sufficient interest to actively stop the theft. Also, security officials of the establishment might not be aware of the activation of the alarm until it is too late to stop the theft. Still further, if the alarm is noticeable to the thief, the thief may make a hasty exit and escape capture.

Thus, it would be advantageous if a means were provided for immediately indicating to the owner of an item and/or security personnel of an ongoing theft. It would further be a benefit if the notification could be silent, so as not to disturb other patrons of the establishment and to aid in the apprehension of the thief.

SUMMARY OF THE INVENTION

The present invention is directed to an anti-theft system for protecting portable personal items attached to the system and remotely signaling their removal.

In an illustrative embodiment, the system has a base which may be secured in place on the edge of a table or a wall. It may be secured by its own weight, suction cups or fasteners of various kinds. A pressure detecting mechanism is operatively disposed to hang from the base so it can be used to hold the personal item, and so that the presence or absence of the item from the pressure detecting mechanism can be detected.

Once the device is activated and a valuable personal item is placed on the pressure detecting mechanism, the removal of the item without first deactivating the device will cause an alarm to be activated. The alarm may be a sound or flashing light on the base of the device. In addition to or as an alternative, the device alarm may generate a signal that may be received remotely by the owner of the item or security personnel of the establishment, which indicates that a theft is in progress. In a preferred embodiment, the signal is a radio frequency (rf) signal with a range of up to about 50-100 yards. This rf signal is received by a portable device on the person of the owner or a security guard, or at a security terminal. When designed to be carried by a person, the receiver is small enough to be conveniently carried in the owner's pocket. As an alternative, it may be in the form of a piece of jewelry, e.g., a broach, which can be conveniently worn by the owner of the item. Further, it is within the scope of the invention to incorporate the receiver into some other item normally worn by the owner, e.g., a watch or ring.

The use of a remote, and potentially silent alarm, improves the chances that a thief will be apprehended before making an escape.

DESCRIPTION OF THE DRAWING FIGURES

These and other features, aspects, and advantages of the present invention will become better understood with reference to the following description, appended claims and the accompanying drawings wherein:

DETAILED DESCRIPTION OF THE PREFERRED EMBODIMENT

Figure 1:
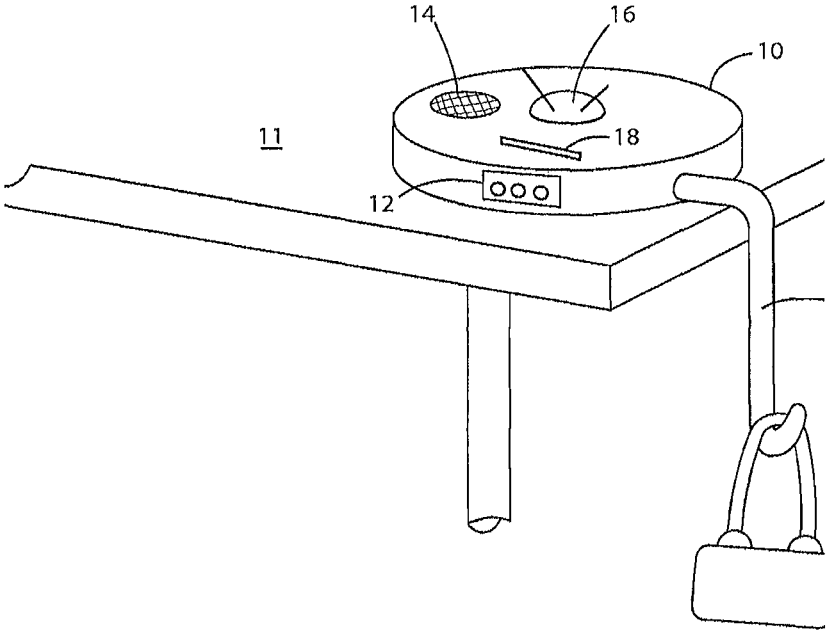
FIG. 1 is a perspective view of a device according to the present invention located on the edge of a table.
Figure 2:
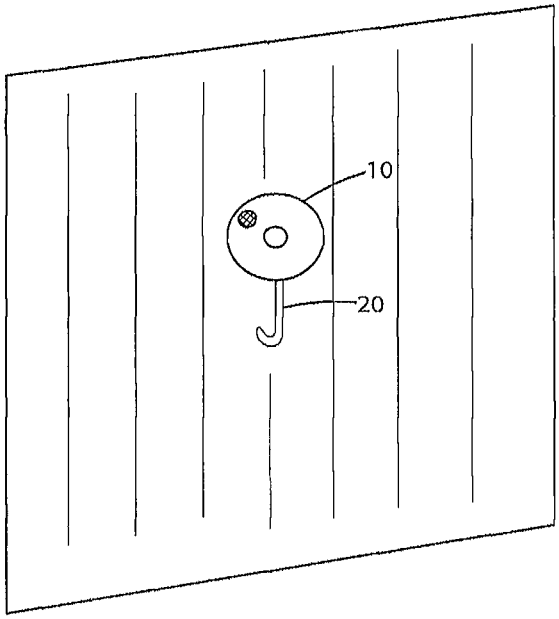
FIG. 2 is an illustration of a device according to the present invention located on a wall.

FIGS. 1 and 2 are illustrations of an anti-theft device according to the present invention. This device is used to prevent the theft of valuable articles that may otherwise be draped over a chair at a club or restaurant. The device has two main parts, i.e., abase 10 and a pressure detecting mechanism 20. The article to be protected, e.g., purse 15, is hung on the pressure detecting mechanism. The article can be anything of value with at least some minimal amount of weight, e.g., a purse, a laptop in a case, an Ipod, clothing, etc.

The base 10 may be held in place on the table by its weight or by some fastening means, e.g., clamps, suction cups or Velcro, on the bottom of the base (not shown). In the embodiment of FIG. 2, the weight of the device is not used to hold it in place on the wall. However, other fastening devices, e.g., clamps, suction cups or fasteners (nails, screws, bolts, Velcro, etc.) may be used to hold it in place.

The device is turned on with a code that is entered through push buttons 12 located on a side wall of the base 10. When the article is placed on the pressure detecting mechanism, the weight of the article is detected by the base through the pressure detecting mechanism. Detection can be by means of the activation of a micro-switch, a strain gauge or some other device capable of detecting the presence of the article on the pressure detecting mechanism. A sensitive strain gauge is preferred when weight is to be detected, since it can be set to detect slight changes in weight on the pressure detecting mechanism, e.g., in the range of the weight of a sweater. If the weight sensitivity of the base is high, the unauthorized removal of even a light weight article, e.g., an expensive sweater, from the pressure detecting mechanism or the removal of some item from an article on the pressure detecting mechanism, e.g., a wallet from a purse, can be detected. Other means of detecting the article on the pressure detecting mechanism can include capacitive coupling, photo detectors, resistance measurements, etc.

Once the presence of the item on the pressure detecting mechanism is detected, e.g., by its weight, the device is in an alarm ready condition. If someone lifts the article from the pressure detecting mechanism without first deactivating the device by entering a code through the pushbuttons 12, the change is sensed in the base. This triggers a circuit in the base, which can be used to produce a signal notifying the owner or security personnel of the attempted theft by way of connection to a mobile computing platform.

When it receives the signal, the mobile computing platform may then initiate a humanly perceivable alter or alarm so as to notify the owner or security personnel. The humanly perceivable alarm may be a sound emitted from a speaker 14, a light 16, a combination of sound and light effects depicted through a display of a mobile computing device. Additionally the mobile computing device may vibrate or otherwise produce a physical condition change indicating that the alarm circuit has been triggered. Additionally, the base device, upon triggering of the signal circuit may produce an alarm consisting of audio or audiovisual components. This alarm is intended to scare the thief away, hopefully without the item, and to notify people in the vicinity of the attempted theft, much like a car alarm. The actual alarm can be in the base or in a remote unit that is connected to the base wirelessly or by wires. An antenna 18 is provided for wireless radio frequency communication with a remote unit. For example, the alarm could be at a security location (50 in FIG. 5) near the front door of the establishment.

While the device may be purchased by an owner of expensive portable personal property and carried to an establishment, it is also contemplated that devices of this type would be purchased by establishments and rented or loaned to patrons. The owner of the establishment or security personnel engaged by the establishment would know the code to activate and deactivate the device. The codes for activation and deactivation may be the same or different. Further, the codes for each device may be the same or different. If the device is distributed from a central location, for example at a coat check for the establishment, then if the alarm goes off, a signal can be sent wirelessly or by wire to security station 50 so that security personnel will be notified. If the security station is near the coat check or the front door, the security personnel will have a chance to apprehend the thief before he can leave the establishment. This opportunity to catch the thief is enhanced if the alarm, at least at the base, is undetectable. In particular, if there are no alarm sounds or flashing lights at the base where the item is being taken, the thief may not know that the theft has been detected. Thus, the thief may not even try to leave the premises, with the hope of stealing more items. Even if the thief does decide to leave, his departure may be at a leisurely pace which will facilitate his capture.

Figure 5:
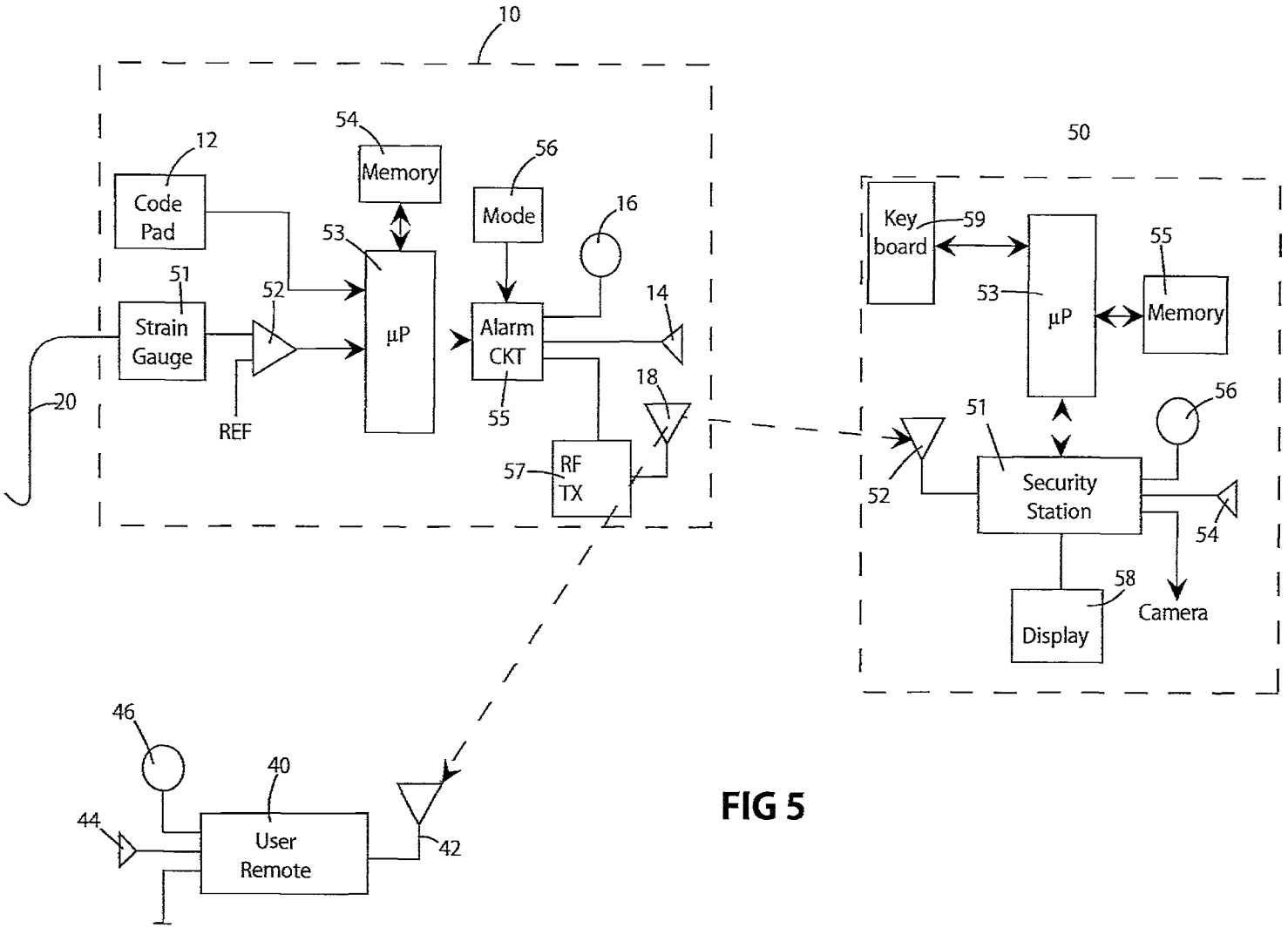
FIG. 5 is a block diagram of a circuit for the device, a remote detector and a computer operated security system for keeping track of multiple devices in an establishment.

Chances of apprehension may additionally be improved if, when the establishment gives out the device, a record is made of the location of the table or wall where it will be used and of a description of the item to be protected. In this way security personnel can move quickly to the location of the theft and can look for someone carrying the described item. If such a record is kept, perhaps in a computer system as shown in FIG. 5, the information may be rapidly and automatically displayed, thus further increasing the chances of apprehending the thief.

Figure 3:
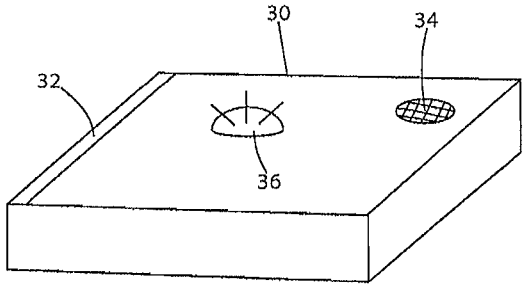
FIG. 3 is an illustration of a remote alarm signal receiver for a user's pocket.

An alarm signal from the base can be sent to a remote device wirelessly using radio frequency (rf) communications. Other wireless communication systems can also be used, e.g., infrared. If it is desired to remotely contact the owner of the item, they can be provided with a device 30 as shown in FIG. 3 which will receive the wireless alarm signal on its antenna 32 and indicate an alarm condition. This may be by way of a sound from a speaker 34 or lights 36. In addition, since the device 30 is designed to be carried in the user's pocket, it may be provided with a vibrator (not shown) to signal an alarm condition when the device is in a user's pocket and it is not visible or easily heard. As an example, device 30 may be configured as a mobile phone with the capability to communicate with the base.

Figure 4:
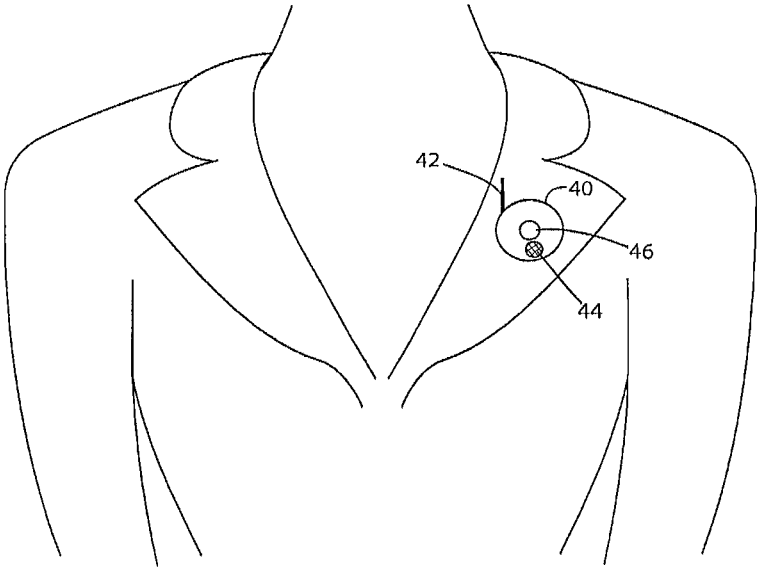
FIG. 4 is an illustration of a remote alarm signal receiver in the form of a broach.

As an alternative, the remote alarm device could be a piece of jewelry as shown in FIG. 4, which is worn by the user, e.g., a broach 40. This device may have an antenna 42 for receiving an r.f. alarm signal, a sound alarm 44, a light alarm 46 and/or a vibration alarm (not seen). Thus, even when the user is not in the vicinity of the article, the user is notified of the attempt to remove the article from the pressure detecting mechanism 20. This same alarm can simultaneously be sent to security personnel at terminal 50 so that they and the owner are notified simultaneously, as indicated schematically in FIG. 5.

When the lawful owner is ready to retrieves the article from the pressure detecting mechanism 20, the owner enters the proper code through buttons 12 on the base 10 to disarm the device so as to prevent an alarm signal from being sent. When the device is rented from an establishment, the owner will have to be provided with the codes by the establishment. This may be part of the coat check procedure for the establishment.

As noted above, the device can be permanently attached to tables or convenient walls of an establishment, e.g. by screw brackets. As an alternative, the establishment can rent or loan the devices to customers to be placed at their table. These devices could be made of heavy metal so that the device is portable, but the weight of the base is sufficient to keep the device in place, even when loaded with an article. In another embodiment, if the device is made light enough in weight and small enough so that it can be carried by a user to a table in an establishment and then irremovably connected to a table or wall, e.g., by clamps or Velcro. If the device is to be sold to individuals, it must also be made small and light enough for a user to carry it over extended distances, e.g., in the user's purse. In such a case, the base would be small, made of a light weight material such as plastic, and would be fastened to the table or wall by clamps or suction cups or Velcro. It should be noted that with light weight portable devices that are releasably coupled to a surface, any attempt to remove the entire device as a means of theft, would cause a sufficient change in the strain on the pressure detecting mechanism 20 so that an alarm would go off.

Turning now to FIG. 5, an exemplary circuit is shown for an embodiment of the present invention. As shown, the pressure detecting mechanism 20 is connected to a pressure gauge 51 which produces an analog voltage signal output depending on the pressure applied to pressure detecting mechanism 20. This output is compared to a reference level in a comparator 52, which produces a binary output whenever the strain exceeds a preset level depending on the reference. This signal, as well as signals from the code buttons 12 are provided to a microprocessor 53 operating a program stored in memory 54.

According to the program, the microprocessor 53 ignores the comparison signals until the code signals instruct it to set the alarm. Then the microprocessor looks for a signal from the comparator 52 that indicates a reduction in the pressure on pressure detecting mechanism 20 due to removal of an item from the pressure detecting mechanism or the lifting of the entire base from the table. If this occurs before a subsequent code signal that tells the microprocessor 53 to disarm the alarm, it will trigger the generation of an alarm signal. The alarm signal is applied to an alarm circuit 55, which depending on the setting of it mode by mode circuit 56, will cause it to trigger lights 16, sound speaker 14 or both in some combination. As an alternative, the alarm may be locally silent, so that neither lights nor sound is produced locally. Instead the alarm circuit 55 triggers a remote warning circuit 57, which may drive a wired connection to a remote site. It may also trigger a wireless signal to a remote site, e.g., an RF transmission through antennal 18. This transmission may be delivered to a remote security terminal 50 and/or to some device on the user, e.g., broach 40. Additionally, this transmission can be sent to a remote computing device such using such operating systems as iOS, Blackberry or Android.

If the wireless signal is received a broach 40, it is picked up by antennal 42 and used to trigger lights 46, speaker 44 and/or vibration generator 48, so that the use can see, hear and/or feel the alarm condition. If the user is away-from his table at the time, the signal will cause the user to quickly return to the take to see if a theft is in progress, or whether someone has accidentally displaced the item.

Since the owner may not be physically capable of apprehending a thief, the signal may be simultaneously transmitted to security terminal 50, which may be conveniently located to intercept a thief seeking to escape the premises. This signal is picked up by an antenna 52, if it is wireless or if the base is permanently installed, the connection to the security terminal may be wired. However, a wired connection is subject to being cut, so that some fail safe condition would be necessary to indicate an alarm condition if the wire is cut.

Whether wired or wireless, the alarm signal is directed from the base to the security station system 51. This system is under the control of microprocessor 53, which operates a program stored in memory 55. System 51, processor 53 and memory 55 may be part of a general security system adapted to incorporate features of the present invention. If an alarm signal is received, lights 56 and sound generator 54 may be operated to alert security personnel. If during the distribution of devices to patrons, information is entered through a keyboard 59 about the identity of the device, the table or wall where it will be located and any description of articles to be protected, this information may be processed by processor 53 and stored in a database that may be part of memory 55. If the alarm signal generated by base 10 includes its identification, the microprocessor can automatically look up the stored information and display it on display 58. Thus the security personnel will not only be notified that a theft is in progress, but the location where it is occurring and the item that is being taken. With this information, someone physically capable of apprehending the thief, and trained to do so, will be immediately dispatched to the area of the crime. In a more sophisticated system, security cameras can be located throughout the premises and can be automatically trained on the location of the theft by the security system.

The present invention is also configured to incorporate a methodology and system for the use of the elements of the anti-theft system herein described. By way of illustration, the remote security terminal of the present invention can be configured as a software module, or series of software modules, so orientated as to operate on a mobile or stationary computing platform. In an alternative embodiment, the present invention RF signal is configured to be generated by a Bluetooth device, wi-fi device or GPS device, RFID signals. These signals can in turn be received or recovered by a portable computing device configured to run the plurality of software modules. In a further embodiment, the plurality of software modules are configured to be executed on a mobile device such as a smart phone (i.e. IOS, Android, Microsoft, or other similarly situated mobile computing platform) or notebook computer or stationary computing device. In this configuration, the anti-theft device of the present invention is registered with a particular mobile computing device by means of a registering software module. Said module is configured to input the characteristics of the device to be monitored (i.e. name, value, or ownership). The registering module can also be configured to associate a particular tone, image, or action (such as a specific ringtone or vibration) to the particular registered anti-theft base device. This can be accomplished via touch screen, or integral keyboard, or other data entry method (such as voice or gesture commands). After a registration of a particular article and associated base device, the software operates as a background process, awaiting a triggering signal from the article, indicative of theft or movement. An additional step is provided wherein upon sensing the movement of the article; a RF signal is sent to a device within range of the article base. For example, in a particular embodiment, when a device has been moved, a direct signal is provided to a RF signal equipped mobile computer platform, for example by bluetooth.

In another embodiment of the present invention, the detection circuit is configured to connect to a remote terminal. This remote security terminal is in turn configured to connect by means of Internet or wireless protocols to a remote security server. The remote security server is configured to send a message or signal to a user's phone by pre-recorded voice mail, text message, or e-mail, at such time as the article has been moved or stolen. In another embodiment of the present invention, the remote security system is capable of using standard wireless telephony communication networks to send an instant message, e-mail or text message to a phone or mobile computing device without the necessity to execute the software modules.

The present invention also configured to act as a proximity sensor through the means of GPS signals. The base device can be either passive (which entails indicating on the registering module the coordinate of the device) or active, wherein the base device is configured with a GPS module that actively updates the remote security device as to its current coordinates. The present invention, in this configuration employs a plurality of steps so as to ensure the base device (and attached article) and the mobile security device are not separated by a large distance. The methodology, in addition to the steps already recited; employ an additional coordinating step, wherein the location, in terms of distance from the mobile security device is calculated. This can be accomplished by comparison of GPS coordinates, or by radio, or signal triangulation. Upon coordination, there is a comparison step, wherein the distance (both in terms of altitude and direct distance), between the device and the mobile security device is calculated. The present methodology provides for a monitoring step wherein the distance is monitored, and once the distance is exceeded, a cue or signal is provided to the mobile security device.

While there have been shown, described, and pointed out fundamental novel features of the invention as applied to preferred embodiments thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is also to be understood that the drawings are not necessarily drawn to scale, but that they are merely conceptual in nature. It is the intention, therefore, to be limited only as indicated by the scope of the claims appended hereto.

What is claimed is:

1. A personal article anti-theft system comprising:

a base retained on a surface having a pressure detecting mechanism connected to the base and configured for attachment to the personal article;

a detection circuit within the base and connected to the pressure detecting mechanism for detecting the presence of an article attached to the pressure detecting mechanism;

a processor executing code stored in a memory and operatively connected to the detection circuit, the processor configured through a plurality of software modules to associate, through user input, the personal article attached to the pressure detection module with the base, determine the removal of an item from the pressure detecting mechanism according to a signal received from the detection circuit, generate an alarm signal in response thereto; and wirelessly transmit the alarm signal including at least data corresponding to the association between the base and the personal article to a remote security server, a remote security server configured with a processor executing code therein to receive the alarm signal and to transmit a pre-determined signal to a receiving device according to the personal article associated with the base; and an alarm receiving device configured to receive wirelessly the alarm signal and configured to produce a humanly perceivable indication of the alarm.

2. The personal article anti-theft system of claim 1 where in the base is retained on a table top near its edge so that the pressure detecting mechanism hangs over the edge.

3. The personal article anti-theft system of claim 2 where in the base is retained on the table top by at least one of its weight, clamps, suction cups, Velcro or fasteners.

4. The personal article anti-theft system of claim 1 where in the base is retained on a wall so that the pressure detecting mechanism hangs down along the surface of the wall.

5. The personal article anti-theft system of claim 4 where in the base is retained on the wall by at least one of clamps, suction cups, Velcro or fasteners.

6. The personal article anti-theft system of claim 1 where the detection circuit includes a strain gauge.

7. The personal article anti-theft system of claim 1 where the wireless communication is by radio frequency signal.

8. The personal article-anti-theft system of claim 7 where the range of the radio frequency communication is up to at least 50 to 100 yards.

9. The personal article anti-theft system of claim 1 further including a key pad on the base for introducing a signal into the alarm circuit to put it into a set condition or to take it out of a set condition.

10. The personal article anti-theft system of claim 1 wherein said an the alarm receiving device has at least one of a light, sound or vibration element to provide the humanly perceivable indication of the alarm.

11. The personal article anti-theft system of claim 1 wherein the remote security server is connected to a network.

12. The personal article anti-theft system of claim 11 wherein the network is a wireless telephony communications network.

13. A method for detecting the theft or movement of an article incorporating the steps of:

registering an article retention system configured with a first GPS receiver with a remote security platform further configured with a second GPS receiver;

configuring an article retention system such that when the article retention system is displaced an RF signal containing at least data corresponding to the GPS coordinates of the article retention system is provided to the remote security platform;

calculating the distance between the article retention system and the remote security platform based on the relative distance between the first GPS receiver and the second GPS receiver comparing the distance calculated to a pre-set value;

alerting a user by issuing a specific audio or visual or vibratory cue, to a mobile device, that is specific to a particular registered system when the calculated distance exceeds the pre-set value.

14. The method of claim 13, wherein the mobile device is a smartphone, or mobile computing platform.

15. The method of claim 13, wherein the audio, visual or vibratory cue is in the form of a pre-set specific tone or message.

16. The method of claim 13, wherein the RF signal is generated by Bluetooth, Wifi, RFID, or other means of RF frequency generation.

17. The method of claim 13, wherein the mobile security platform is capable of interpreting RF signals containing GPS information and display the location on a map, blueprint or other location illustration.

* * * * *